United States Patent [19]

Baker

[11] 4,276,661

[45] Jul. 7, 1981

[54] WAVE-MAKING APPARATUS

[76] Inventor: William H. Baker, 30 Honeysuckle Woods, Clover, S.C. 29710

[21] Appl. No.: 7,541

[22] Filed: Jan. 30, 1979

[51] Int. Cl.[3] ..... E04H 3/18; E02B 3/00; F04D 35/00

[52] U.S. Cl. ..... 4/491; 272/26; 405/79; 417/342; 272/26

[58] Field of Search ..... 4/172, 172.11, 172.16, 4/178; 405/76, 79; 417/342

[56] References Cited

U.S. PATENT DOCUMENTS

| | | | |
|---|---|---|---|
| 490,484 | 1/1893 | MacKaye | 4/172.16 X |
| 586,983 | 7/1897 | Wharton | 4/172.16 |
| 1,377,163 | 5/1921 | Pool | 405/76 X |
| 2,002,043 | 5/1935 | Price | 4/172.16 |
| 2,019,829 | 11/1935 | Price | 272/26 X |
| 2,056,855 | 10/1936 | Herz | 4/172.16 |
| 2,222,010 | 11/1940 | Witte et al. | 4/172.16 X |
| 2,715,366 | 8/1955 | Vartiainen | 405/76 X |
| 3,005,207 | 10/1961 | Matrai | 4/172.16 X |
| 3,473,334 | 10/1969 | Dexter | 4/172.16 X |
| 3,477,233 | 11/1969 | Anderson | 405/79 |
| 3,516,761 | 6/1970 | Scroggins | 417/342 X |
| 3,557,559 | 1/1971 | Barr | 4/172.16 X |
| 3,629,877 | 12/1971 | Schuster et al. | 4/172.16 |
| 3,789,612 | 2/1974 | Richard et al. | 4/172.16 X |
| 3,872,769 | 3/1975 | Rosling | 417/342 X |

FOREIGN PATENT DOCUMENTS

| | | | |
|---|---|---|---|
| 716775 | 8/1968 | Belgium | 4/172.16 |
| 2004528 | 8/1971 | Fed. Rep. of Germany | 4/172.16 |
| 375684 | 6/1932 | United Kingdom | 4/172.16 |

*Primary Examiner*—Stuart S. Levy

[57] ABSTRACT

An apparatus is provided for making waves in bodies of water used for swimming having a multicompartmented chamber with at least one set of separate paired compartments open in a nonintercommunicating lower portion for separate reception of water therewithin from a body of water, and closed in an intercommunicating upper portion in a manner to provide a fluid-tight upper portion confining therewithin a volume of fluid that is common to each pair of compartments; and at least one pair of pistons, each disposed in separate paired compartments in the chamber, each piston being mounted across its compartment for reciprocation in alternating power and suction strokes and arranged for fluid-pressure-induced interreaction with the other piston in balanced strokes; each piston having an upper face with a pressure-receiving surface responding to fluid pressure in the upper portion of its compartment, and a lower face with a pressure-receiving surface responding to water pressure in the lower portion of its compartment; whereby on the power stroke each piston pushes water below it in the lower portion of its compartment into its passage and via its port into the body of water, and on the suction stroke each piston draws water from its passage via its port into the lower portion of its compartment, the resulting alternating pulses of water flow generating waves in the body of water.

18 Claims, 8 Drawing Figures

2
38
39
36
34
32
PRESSURE CYLINDERS
28
30
1
3
40
41
35
33
37
31
13
23
20
11
PISTON
29
AIR CHAMBER 14
AIR CUSHION IN PISTON
22
25
21
L2
W/L
AIR CUSHION IN PISTON
24
26
N
15
L1
W/L
N
7
27
16
4
RETAINING SCREEN
17
RETAINING SCREEN
18
9
5
2

5

69
70
71
72
57
55
58
PRESSURE CYLINDERS
56
65
40
67
43
68
48
60
50
49
AIR CHAMBER 49
66
47
61
63
W/L
L2
N
62
W/L
L1
44
RETAINING SCREEN
53
RETAINING SCREEN
54
45
46
5

WAVE-MAKING APPARATUS

Devices for making artificial waves in bodies of water have been known for a very long time.

U.S. Pat. No. 490,484 dated Jan. 24, 1893 to Mackaye describes a wave-making device for use in creating a theatrical effect, intended to produce wave effects over the range of gentle waves, or a succession of waves, or a "choppy" or rough and stormy sea. The device utilizes a vibratory or reciprocable arm or pendulum lever pivotably attached at its upper end to a fixed support with a wave-shoving pusher plate or blade at its other end, and a power shaft attached to a flywheel that is motor driven and drives the arm back and forth in a pendulum-like shoving motion in a horizontal plane, slowly or rapidly, as desired.

Wharton Jr. U.S. Pat. No. 586,983, patented July 27, 1897, also utilizes a reciprocating feathering blade or blades also adapted to move in a horizontal plane along the bottom of the water body and operated by a flywheel.

As swimming pools came into vogue and grew in size, it became apparent that wave-making devices intended for theatrical purposes could be modified to create wave action in a swimming pool. However, devices provided with laterally-reciprocating blades and levers moving about in the body of water were a hazard to swimmers, and another way of achieving the wave action had to be developed.

British Pat. No. 375,684 patented June 30, 1932 shifted the wave-making movement to a vertical plane, and applied air pressure to move the body of water back and forth. Water from the pool was drawn up into a vertical chamber by suction, after which the suction was broken, and air was admitted to the chamber, so that the body of water thus elevated was allowed to fall freely back into the pool. This system avoided all of the mechanical contrivances previously used, but, water being heavy, in order to draw the water up to a sufficient height to create a wave large vacuum pumps were required, which consumed considerable amounts of power.

Another way of achieving wave action in swimming pools utilized reciprocating displacers operating at slightly different speeds, so that there was a cyclic variation of relative stroke position, with regular repetition of the full cycle of variations at intervals determined by the number of strokes constituting the cycle. The displacers were commonly reciprocated approximately in harmonic motion by operating each displacer through a connecting rod driven from a crank. With two displacers driven at slightly different speeds, one crank is continually gaining on the other, and the respective cranks pass through the whole range scale of phase differences during a complete cycle of wave variations. At one time the two cranks will be in phase, at another time 90° apart, and at another time 180° apart. When the cranks are in phase, the highest waves are produced. When the cranks are not in phase, diagonal waves are produced. When the cranks are about 90° apart small rather choppy waves are produced. When the displacer cranks are about 180° apart, one displacer makes downward or forward strokes concurrently with upward or return strokes of the other displacer.

This however leads to considerable short circuiting of water between the two displacers, and this problem was tackled by Price, U.S. Pat. No. 2,002,043, patented May 21, 1935. Price operated a plurality of displacers at all times in phase, so that the short circuit pumping is eliminated. The variation in wave formation is produced by varying the length of the stroke or vibration of one displacer relatively to the others. The displacer was a piston moving up and down in a vertical shaft or chamber, utilizing a walking beam-type of leverage to achieve reciprocation of the piston. The lower face of the piston was in direct contact with the water, and the water was drawn in and pushed out from the chamber in accordance with the vertical position of the piston within the chamber.

In U.S. Pat. No. 2,019,829 patented Nov. 5, 1935, Price indicated that the problem with the utilization of displacers is the large size required, each displacer being ordinarily about 20 feet long or more, and usually constructed of wood. Accordingly, Price sought to reduce the size and simplify the construction of the displacer, but essentially the same wave-making principle is employed in this modified device as well.

Herz U.S. Pat. No. 2,056,855 patented Oct. 6, 1936 returned to the suction principle first utilized in British Pat. No. 375,684. However, Herz not only exhausted air from the compartment to raise the level of the water above the normal quiescent level of the pool but also forceably lowered the water to below the level of the pool by application of pressure. Thus, the water is alternately drawn from the pool and then discharged therefrom under pressure, which amplified the wave-making action of the pulse of water moved up and down in the chamber. While this modification improved the wave-making capability of the system, it also considerably increased the power requirement, and made it even more costly to operate.

Witte et al U.S. Pat. No. 2,222,010, patented Nov. 19, 1940, created waves in the water body by moving a tank-size plunger up and down in the water. Witte et al were primarily interested in theatrical effects, since of course this movement would have been dangerous to swimmers. The tank was reciprocated by a piston, using compressed air.

Matrai U.S. Pat. No. 3,005,207 patented Oct. 24, 1961 utilizes a flip-flop pivotable shover blade sheltering the blade or paddle in a special wave-making housing. An oscillatory motion about the pivot point is imparted to the paddle by a drive shaft moving the paddle back and forth in a full 180° of travel or oscillation, flip-flopping first to one side and then to the other side of the pivot mounting.

Schuster and Boes, Belgian Pat. No. 716,775 granted on Aug. 30, 1968 and issued on Dec. 2, 1968, modified the Herz approach of U.S. Pat. No. 2,056,855 by eliminating the suction part of the cycle, and simply applying air pressure to force the body of water down in a chamber, utilizing compressed air which is applied directly to the water surface. Preferably, the air is alternately led successively upon two adjacent parts of the surface of the pool water, thereby communicating a wave movement to the water in such a way that the maximum height of the waves is located in the middle of the pool. An uneven number of water chambers is provided along one side of the pool, with adjacent chambers alternately being placed in contact with the source of compressed air. If the widths of the chambers is made a multiple of the wavelength of the waves, with a phase displacement of 180° in the apparatus, a body of waves is produced with maximum height in the middle of the pool, unlike the mechanical apparatus previously described, where the phase displacement is relatively small in the middle and strong at the borders of the body of water.

Dexter U.S. Pat. No. 3,473,334, patented Oct. 21, 1969, sought to provide waves of the spilling breaker-type, suitable for surfing. A pump takes water from the pool and discharges it into the wave-producing device, raising the water level in the wave-producing device above the normal water level of the pool. Then a gate in the bottom of the device is opened, and as the water within is lowered, a controlled quantity is forceably expelled into the pool at a distance below the surface. Substantially all of this expelled portion is deflected upwardly, to create a translatory surface wave upon the body of water, producing waves by utilizing the potential energy of the hydraulic head of the raised portion of water, and a properly proportioned directional control. The pumping rate into the wave-making device is related to the rate of water released to the pool.

Andersen U.S. Pat. No. 3,477,233, patented Nov. 11, 1969, provides a device for making waves on the free surface of a body of water utilizing a buoyant member which is at least partially submerged in the water, and yet floats thereon. Driving means is applied to the buoyant member because of periodic motion thereof relative to the surface of the liquid, such that the amplitude of the motion relative to the surface is unaffected by the level of the surface. The relative motion causes substantial variations in the liquid displacement of the buoyant member.

Barr U.S. Pat. No. 3,557,559 patented Jan. 26, 1971 also is concerned with creating surfing waves. A breaker is formed when the base border of a wave travelling through a body of water impinges a relatively sharply inclining body or floor on the body of water, with the result that the motion of the wave base relative to the wave crest is retarded, due to viscosity, and the crest of the wave advances relative to the base until the latter is no longer capable of vertically supporting the crest, at which point the water in the crest spills over the wave front, and the wave is said to "break".

Barr seeks to duplicate the natural surfing "breaker" wave by confining the water in a trough, and then utilizes a ram-type or pumping pressure discharge-type of pushing device, operating in a horizontal plane, to shove the water down the trough. The drawings show a ram coupled to a power source which thrusts the ram outwardly, causing the surge of water to be forced along the deep channel of the trough, after which the ram is retracted. The principle is thus similar to that of Mackaye and Wharton, with the exception that the water is confined between high walls.

Schuster and Boes, U.S. Pat. No. 3,629,877, patented Dec. 28, 1971, provides a device in which the swimming pool has a width equal to at least one wave length of the waves in the water, and a standing wave is caused to move along the length of the pool by applying force alternately on first and second adjacent parts of water surface across the width of the pool, with a wave generator in the form of a buoyant plunger mounted for vertical reciprocation within a chamber having an opening facing the pool. Through a cyclic control system, the plunger is driven in phase with the forces of gravity and buoyancy acting thereon, starting from a rest position through strokes of increasing amplitude until a desired steady state is attained, to sequentially produce waves of the desired energy.

In one form of wave generator, the reciprocating enclosure has an open bottom with air purge valves on its upper face connected to a prime mover for raising the enclosure. Upon lowering the enclosure, the purge valves open, allowing air to escape, while the open lower end of the tank enters the water for filling to a predetermined level. Then, when the tank is pulled up with the purge valve closed, a volume of water within the tank is upwardly displaced, and released when the hydrostatic equilibrium between the contained water and the outer water is upset, as when the open lower end of the tank breaks the surface of the water.

All of these devices have in common relatively high costs of operation and maintenance. When the water is moved by application of mechanical means such as a reciprocable paddle, blade or piston, there is considerable wear and tear on the mechanical parts, due to the weight of the water, and the impact of the mechanical parts on the water when they change direction. If air pressure or compressed air is used as the motive force, a considerable pressure has to be built up before the water can be made to move at a rate sufficient to create a wave, and this requires considerable energy, applied through compressors, which are quite expensive to operate, and which also may require cooling devices because of the heat released in the compression of the air.

In accordance with the invention, a wave-making apparatus is provided which diminishes the energy requirement in wave-making by utilizing paired pistons arranged for interaction with each other in balanced strokes, with the movement of each piston of a pair engaged in a power stroke interreacting with the opposed movement of the other piston of a pair in a suction stroke. In addition to the linking of the pistons in pairs in this way, a multi-compartmented chamber is provided, having at least one set of separate paired compartments for the two paired pistons, one piston in each separate paired compartment. The compartments are closed in an intercommunicating upper portion in a manner to provide a fluid-tight upper portion, confining therewithin a volume of fluid that is common to each pair of compartments. Thus, when one of the pistons in a pair moves in its power stroke, the change in fluid pressure in the volume of fluid confined in the intercommunicating upper portions of the separate paired compartments, combined with the water pressure below the pistons, results in moving the other piston of the pair in its suction stroke, and puts it into position for its next power stroke, by the time the first piston has ended its power stroke.

The apparatus in accordance with the invention comprises, in combination, (1) a housing;

(2) a multi-compartmented chamber in the housing having at least one set of separate paired compartments open in a nonintercommunicating lower portion for separate reception of water therewithin from a body of water, and closed in an intercommunicating upper portion in a manner to provide a fluid-tight upper portion confining therewithin a volume of fluid that is common to each pair of compartments;

(3) at least one pair of pistons each disposed in separate paired compartments in the chamber, each piston of a pair being mounted across its compartment for reciprocation in alternating power and suction strokes and arranged for fluid-pressure-induced interreaction with the other of each pair in balanced strokes, with the movement of each piston engaged in a power stroke interreacting with and inducing opposed movement of an interreacting piston of a pair in a suction stroke, according to pressure changes in the fluid volume common thereto;

(4) each piston having an upper face with a pressure-receiving surface responding to fluid pressure in the upper portion of its compartment, and a lower face with a pressure-receiving surface responding to water pressure in the lower portion of its compartment;

(5) a plurality of separate passages and ports in the housing, each piston-containing compartment being in flow communication with its own passage and port, each passage admitting water into the housing from the body of water, the passages and ports being isolated from each other within the housing; whereby on the power stroke each piston of a pair pushes water below it in the lower portion of its compartment into its passage and via its port into the body of water, and on the suction stroke each piston of a pair draws water from its passage via its port into the lower portion of its compartment, the resulting alternating pulses of water flow generating waves in the body of water beyond the housing moving in an outward direction from the housing, and on the power stroke of one piston of a pair the fluid pressure reduction in the volume of fluid confined in the intercommunicating upper portions of the separate paired compartments of the interreacting piston pair combined with the water pressure below the interreacting piston of the pair results in actuating that piston on its suction stroke, and puts it in position for its next power stroke by the time the first piston has ended its power stroke.

Preferred embodiments of the invention are shown in the drawing, in which.

Figure 1:
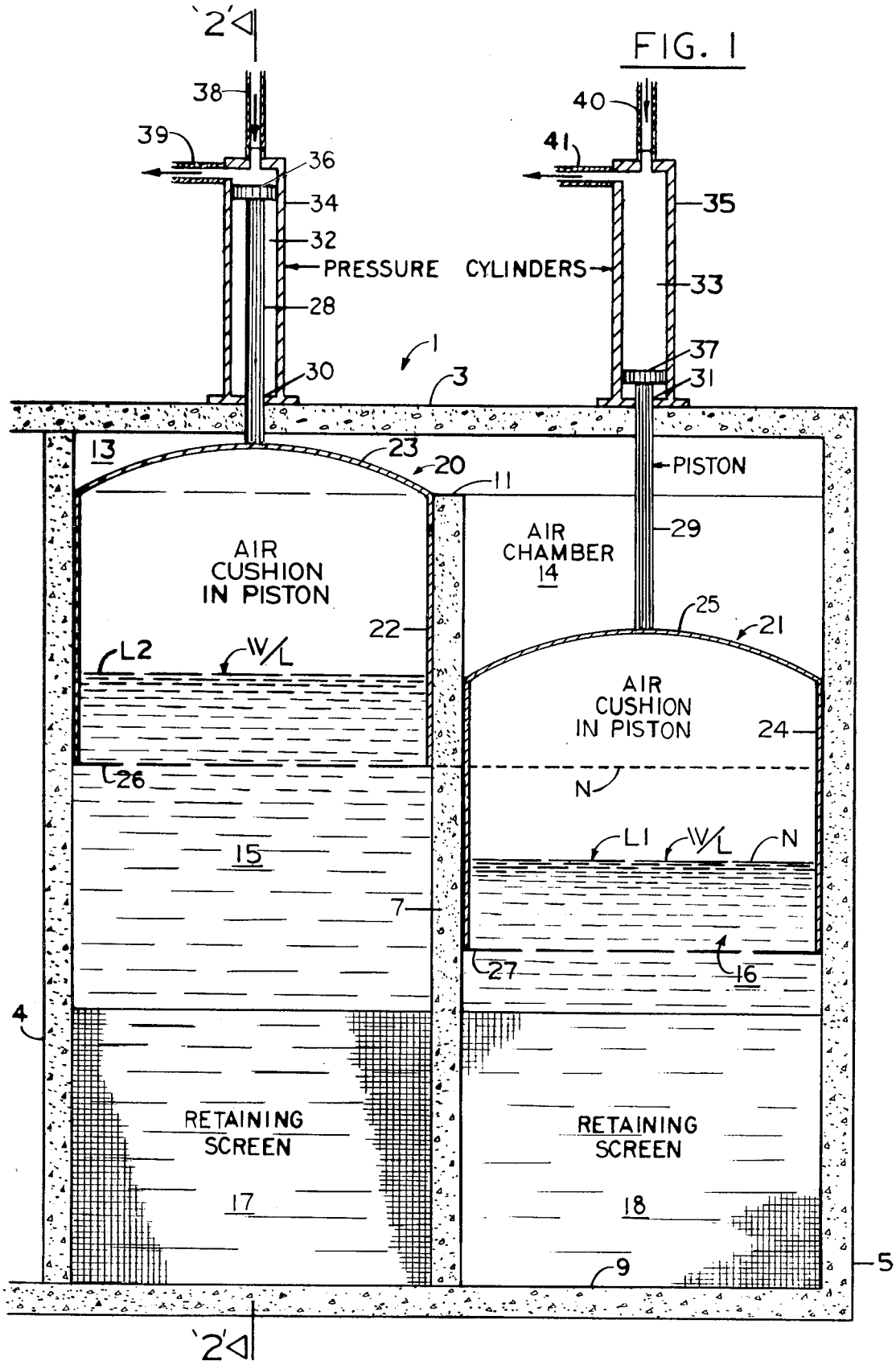
FIG. 1 represents a longitudinal section seen from the front through a pair of compartments with interreacting open-bottomed pistons therewithin.
Figure 2:
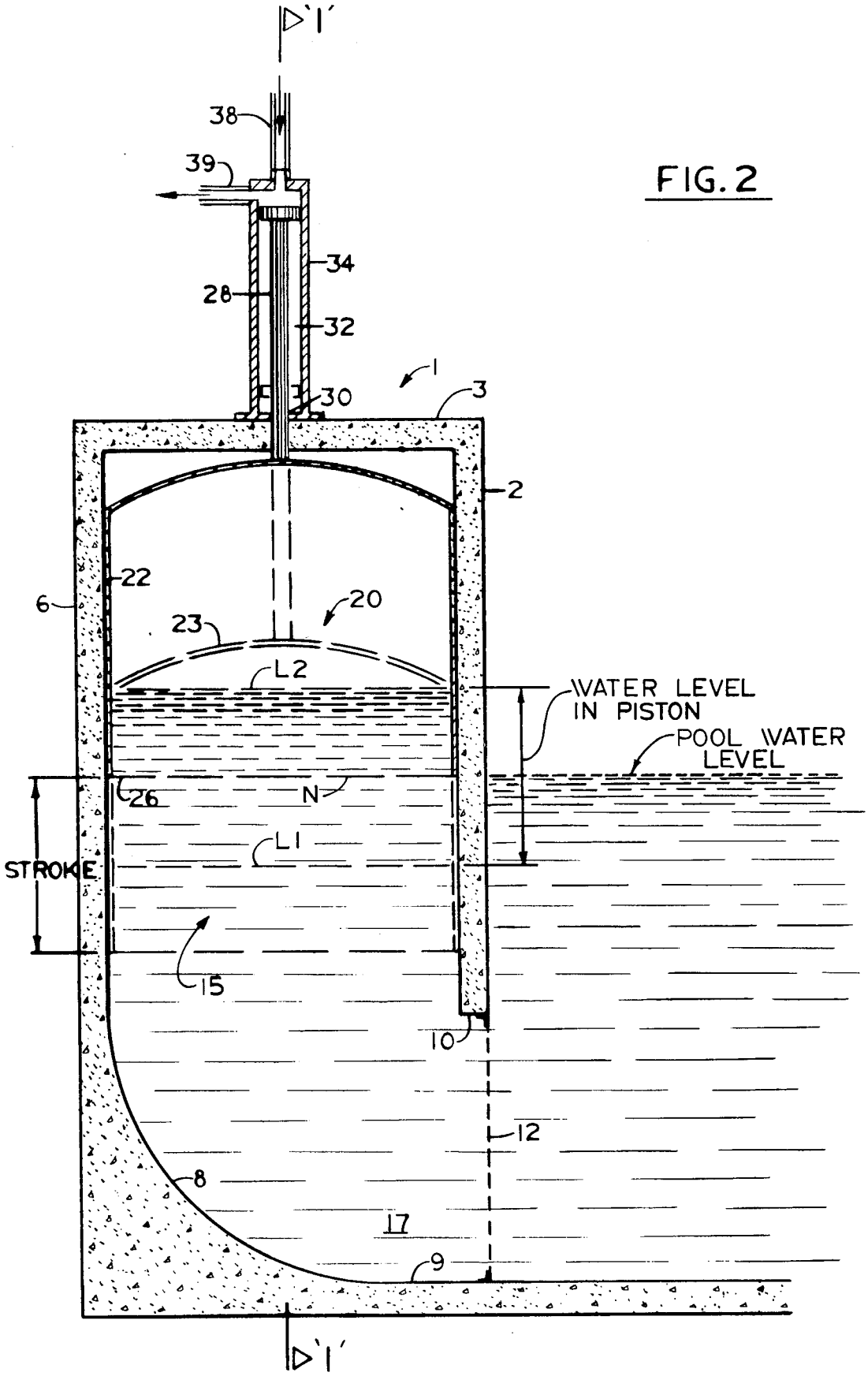
FIG. 2 represents a longitudinal sectional view seen from one side of the chamber shown in FIG. 1.
Figure 3A:
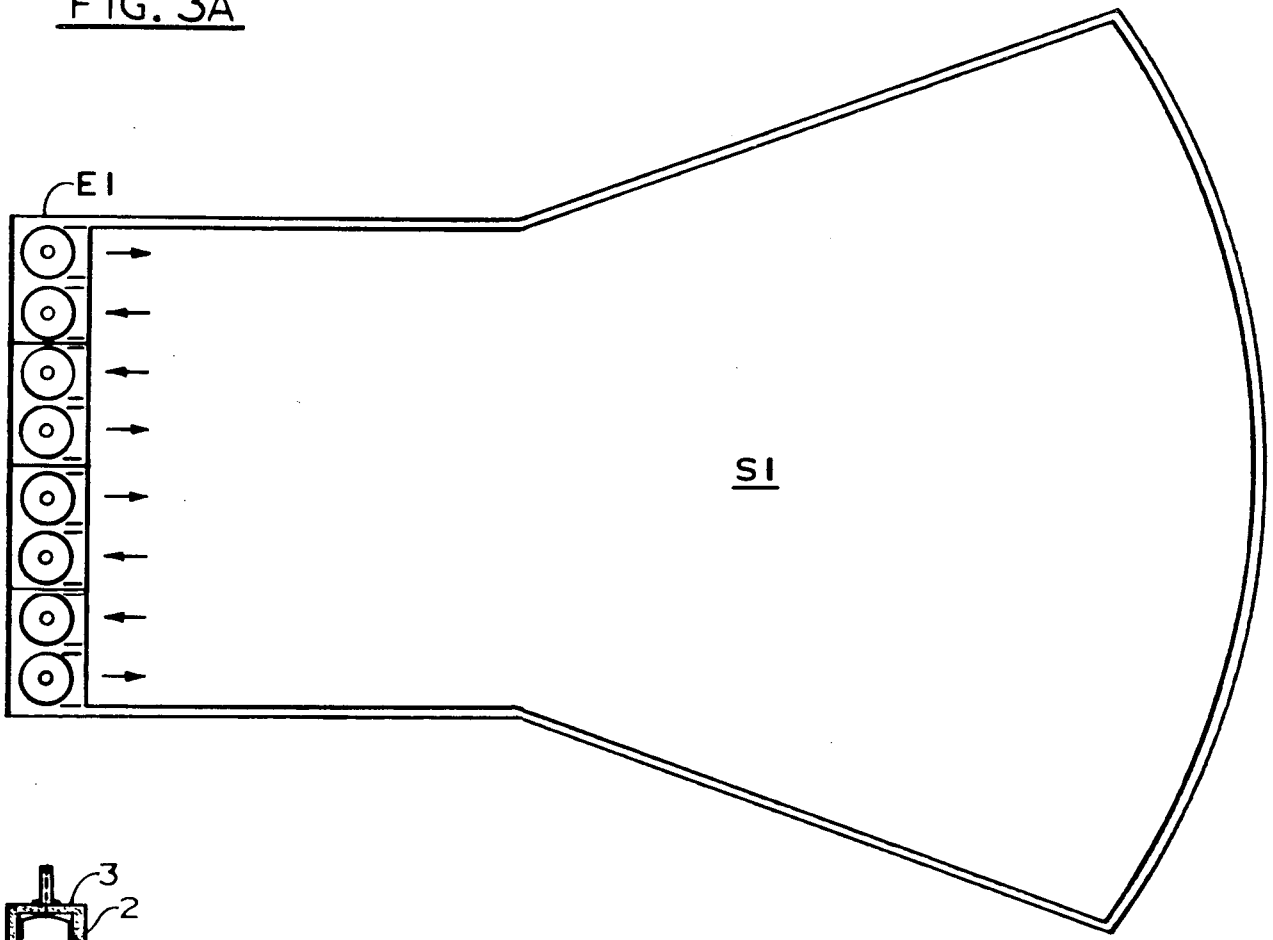
FIG. 3A represents a plan view of a swimming pool incorporating an array of four such paired compartments at one end.
Figure 3B:
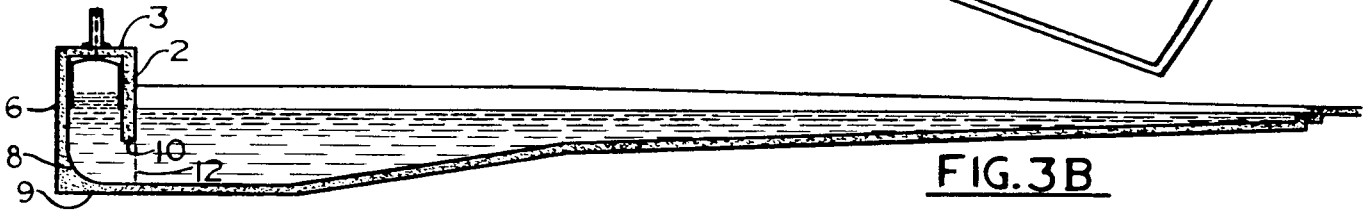
FIG. 3B represents a longitudinal sectional view of the swimming pool of FIG. 3A.

The wave-making apparatus shown in FIGS. 1 to 3B has a housing 1 extending transversely all the way across one end E1 of a swimming pool S1 (see FIG. 3A). The housing has a front wall 2, a top wall 3, side walls 4, 5 and a back wall 6, with wall 7 separating the compartments or chambers 15, 16, which are closed off at the bottom by wall 9. As seen in FIG. 2, the front wall 2 of the housing stops short of the bottom 9, defining an opening 10 leading to the pool, while the back wall 6 of the housing is curved along its lower end surface 8 in chambers 15, 16 so as to provide a smooth line of flow from the upper portion of the chamber 15 through the opening 10 to the pool.

Across the opening 10 is placed a protective screen 12, so as to prevent swimmers from entering the chambers with all or part of their body.

Within the one chamber 15 of the pair is a piston 20, and within the other chamber 16 of the pair is a piston 21. The pistons can for example be six feet in diameter and with a three foot stroke. The pistons are closed off at the top 23, 25 and sides 22, 24 but open at the bottoms 26, 27, so that water enters from below to water level W/L. Extending upwardly from the tops 23,25 are piston rods 28, 29 which run through the apertures 30, 31 in the top 3 of the housing 1 into the piston chambers 32, 33 of the pressure cylinders 34,35. The pressure cylinders are attached to a pressure source (not shown) via lines 38 and 40, and can be pressurized with fluid such as air or oil from this source. While being pressurized the pistons 20, 21 are driven downwardly on their power stroke. The piston cylinders also have lines 39, 41 running to a relief valve (not shown) for reducing pressure in the piston chamber when the piston is ready to start its return or suction stroke, making its return possible (see FIG. 1).

The lower portions 17, 18 of the chambers 15, 16 receive water which enters from the pool via the openings 10 and fills the chambers to a normal water level N. The upper portions 13,14 of the chambers 15, 16 are closed off by the upper portion of the housing, and are relatively fluid-tight. The two chambers 15, 16 are intercommunicating via the passage 11 above the separating wall. There is accordingly an upper air space common to the two chambers. The volume of air therein is captured in this space, and cannot escape therefrom, but it is displaced therein according to the relative positions of the pistons 20, 21 in the chambers 15, 16 and changes in pressure slightly as the pistons begin their power strokes, as will presently be seen.

It will also be seen that an air pocket exists in the upper part of the interior of each piston, above the level of water within the piston. This air is under pressure according to the position of the piston with respect to the normal water level N, and constitutes an air cushion.

If the piston is moved down to the limiting position where the piston is extended fully from the pressure cylinder, below the normal pool water level, the air within the piston will be compressed. At the same time, the water level in the chamber will be forced down below the normal pool level, to the level L1. On the other hand, when the piston is fully elevated, and at the other end of its stroke, with the piston at the top of the hydraulic cylinder, then the air pocket or cushion within the piston will be under a less than atmospheric pressure, while at the same time the water level in the chamber will be carried upwardly to the level L2.

In the device shown, since the stroke of each piston covers a span of three feet, with the normal water level N at about halfway, the water level is depressed about 1½ feet below the surface or raised about 1½ feet above the normal level N at the limits of each stroke. This stroke can be adjusted in length or span by varying the pressure in the cylinder and/or by varying the speed of the stroke.

Operation of the device is as follows:

The power supply (not shown) is turned on, and fluid such as air or oil under pressure forced into one of the pressure cylinders (let us assume in this case the cylinder 35) driving the piston downwardly on its power stroke, and bringing the piston into the position shown in FIG. 1, with the water level in chamber 16 at L1. At the same time, the cylinder 34 is exhausted, and the piston 20 is raised to the uppermost position shown in FIG. 1, with the water level in chamber 15 at L2. The piston 20 in reaching this position is aided, firstly by water pressure in the chamber 15, initially depressed at level L1, and secondly, by the displacement of air in the upper portion 13 of the chamber to portion 14 of chamber 16 with the downward stroke of the piston 21 in the other chamber. This slightly increases the air volume in chambers 13, 14, reducing the air pressure, which aids in driving the piston 15, upwardly into the position shown in FIG. 1.

While this is going on, water is driven out of the portion 18 of chamber 16 through the opening 10, while water enters the portion 17 of chamber 15 through the opening 10.

At the end of its stroke, the piston 21 has reached its lower limit, while piston 20 is now at its uppermost position, and is ready for the power stroke. Now, pressure in cylinder 35 is relieved, while fluid under pressure is admitted to cylinder 34.

This forces the piston 20 downwardly on its power stroke, and it moves into its lower position, forcing the water out of the compartment 15 as it does so. The combined effect of the water pressure in the compartment 16 against piston 21 plus the displacement of air in the upper portions 13, 14 of the chambers 15,16 drives the piston 21 into the upper position, and it is now ready for its power stroke on the next cycle. The cycle is then repeated.

The speed of the waves produced will depend in part upon the rate of movement of the pistons 20, 21 up and down. The faster the rate, the more water is displaced per unit time, and the faster the wave action.

The size of the waves is controlled by the length and speed of the piston stroke. Maximum size waves are obtained with a full fast stroke, and smaller waves by shorter slower strokes.

At the same time, inasmuch as the water is displaced only from adjacent compartments in sequence, and is simultaneously absorbed in the next-adjacent compartments, waves are created not over the entire width of the pool but only over those portions of the width opposite the chambers in which the pistons are on their power stroke. The piston pairs because of the manner in which they are linked create waves with a 180° phase displacement, which achieves the same effect described in Belgian Pat. No. 716,775. There is however an even number of pistons along the end of the pool, when each piston is a part of an interacting piston pair, instead of an odd number, as in the Belgian patent, unless the end pistons in each array are not paired.

Any conventional means can be employed for operation of the hydraulic cylinders, as desired, such as an electric motor, a gasoline engine, a diesel engine, a windmill, or other conventional means.

Figure 5:
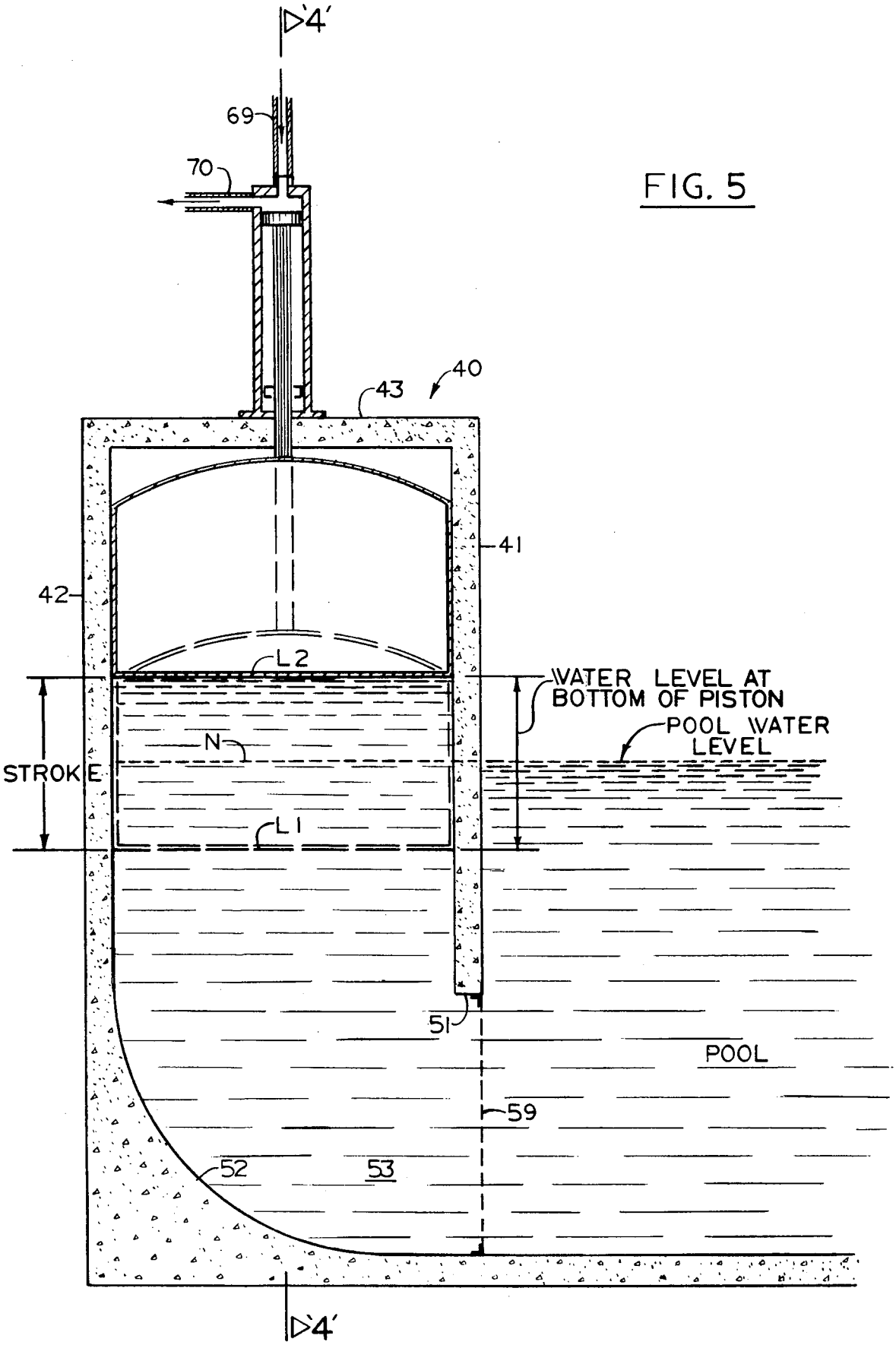
FIG. 5 represents a longitudinal section seen from one side of the chamber shown in FIG. 4.
Figure 6A:
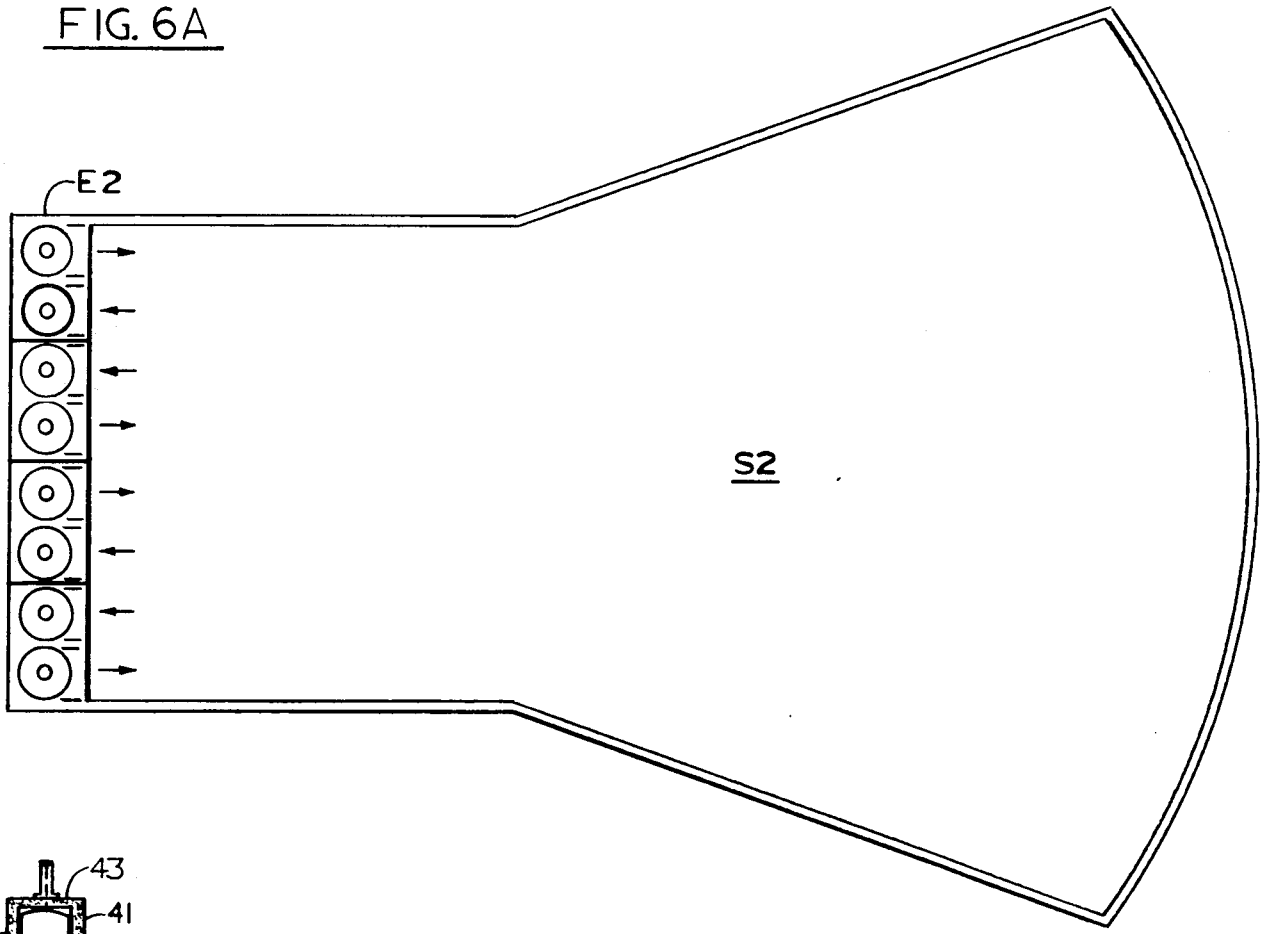
FIG. 6A represents a plan view of a swimming pool incorporating an array of four such paired compartments at one end.
Figure 6B:
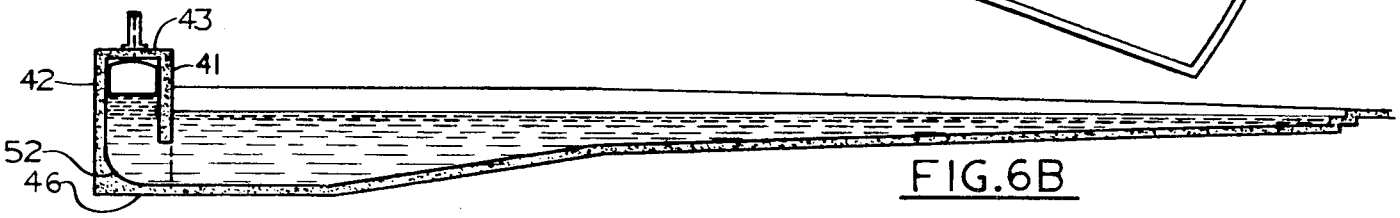
FIG. 6B represents a longitudinal sectional view of the swimming pool of FIG. 6A.

The air cushion within each piston avoids direct shock between a piston surface and the water, thus reducing wear and tear on the pistons and the piston reciprocating mechanism. However, if this is no problem, then the wave-making apparatus shown in FIGS. 4 to 6B can be used. This apparatus has a housing 40 extending transversely across one entire end E2 of a swimming pool S2 (see FIG. 6A). The housing has a front wall 41, back wall 42, top wall 43, side walls 44, 45 and bottom wall 46, with a wall 47 separating compartment 48 from compartment 49. The compartments are in communication via opening 50. As seen in FIG. 5 the front wall 41 of the housing stops short of the bottom defining an opening 51 leading to the pool, while the back wall 42 of the housing is curved at 52 along its inner surface, so as to provide a smooth line of flow through the lower portion 53 of the chambers through the opening 51 to the pool S2.

Within the chamber 48 is a piston 60 and within the other chamber 49 of the pair is a piston 61. The pistons can for example have a diameter of six feet, and a stroke of three feet. The pistons are hollow, to reduce weight and inertia, and are closed off at the top, sides, and bottom. Extending upwardly from the top of each is a piston rod 65, 66 which runs through the aperture 67, 68 in the top 43 of the housing 40 into a piston chamber 55, 56 of the pressure cylinders 57,58. The pressure cylinders are attached via lines 69, 71 to a pressure source (not shown) and can be pressurized with fluid such as air or oil from this source. Lines 70, 72, run to relief valves (not shown) which in each cylinder are opened to reduce pressure at the end of each power stroke, to permit the return or suction stroke (see FIG. 1).

It will thus be evident that the lower portions 53, 54 of the chambers 48, 49 are open to water which enters from the pool via openings 51 and tends to fill the chambers to a normal water level N, while the upper portions of the chambers are closed off by the upper portion of the housing, and are relatively fluid-tight. Since the two chambers 48, 49 are intercommunicating via the passage 50 through the separating wall 47, there is accordingly a common air space to the two chambers, and a volume of air is captured in this space, and cannot escape therefrom.

It will also be seen that if the pistons are moved down to the lower limiting position, such as shown for piston 61 in FIG. 4, where the piston is extended fully from the pressure cylinder 58, the level of water in the chamber 49 will be forced down below the normal pool level to the level L1 at the bottom face 62 of the piston. On the other hand, when the piston is fully elevated to the other end of its stroke, such as shown for piston 60 in FIG. 4, with the piston at the top of the pressure cylinder 57, then the water level in chamber 48 rises to the bottom face 63 of piston 60, to the level L2.

Across the opening 51 is placed a retaining screen 59, so as to prevent swimmers from entering the chambers 48, 49 with all or part of their body.

In the device shown, since the stroke of each piston covers a span of three feet, the water level is depressed 1½ feet below or raised 1½ feet above the water level in the pool at the limit of each stroke. This stroke can be adjusted in length or span by varying the pressure in the cylinder and/or by varying the speed of the stroke.

Figure 4:
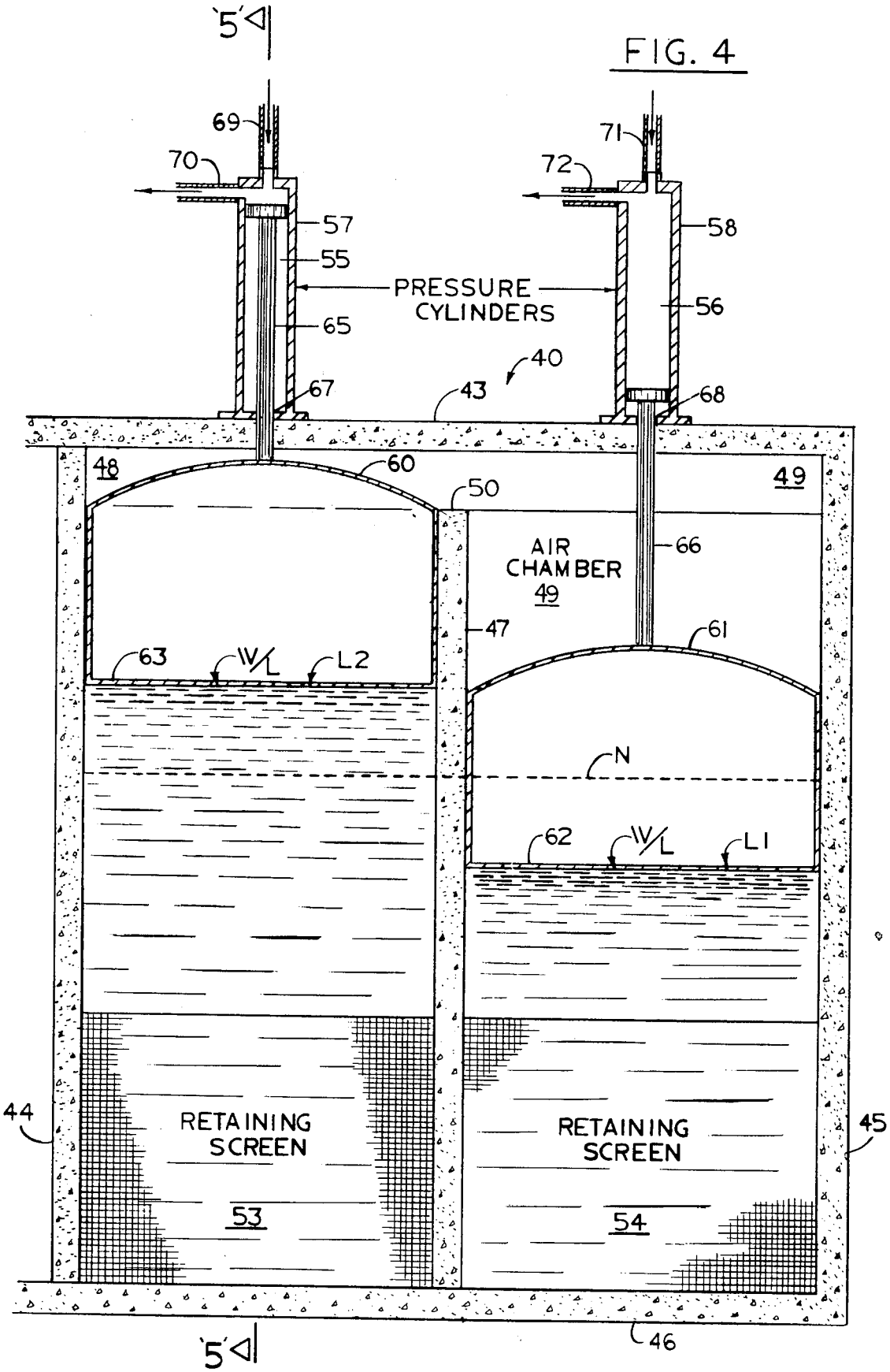
FIG. 4 represents a longitudinal section seen from the front through another embodiment in which the interreacting pistons have closed bottoms.

Operation of the device is as follows:

The power supply (not shown) is turned on and fluid such as air or oil under pressure forced into one of the pressure cylinders, such as the cylinder 58, driving the piston 61 downwardly on its power stroke and bringing the piston into the position shown in FIG. 4. At the same time, the cylinder 57 is exhausted and the piston 60 is raised to the uppermost position shown in FIG. 4, aided firstly by water pressure at level L1 in the chamber 48, and secondly by the displacement of air in the upper portions of the chambers 48, 49 with the downward stroke of the piston 61 in the other chamber 49. This increases the air volume in that chamber, reducing the air pressure, which aids in driving the piston 60 upwardly into the position shown in FIG. 4.

While this is going on, the water is driven out of the compartment 49 through the opening 51 into the pool, and enters the compartment 48 through the opening 51.

When the stroke of the piston 61 has reached its limit, piston 60 is now at its upper most position, and is ready for its power stroke. Now, pressure in cylinder 58 is relieved, and the fluid under pressure enters the pressure cylinder 57. This forces the piston 60 downwardly on its power stroke, and it moves into the lower position, forcing the water out of the compartment 48 as it does so. The combined effect of the water pressure in the compartment 49 at level L1 against piston 61 plus the displacement of air in the upper portion of the chambers 47, 48 drives the piston 60 into the upper position, and it is now ready for its power stroke on the next cycle. The cycle is then repeated.

The speed of the waves produced will depend in part upon the rate of movement of the pistons 60, 61 up and down. The faster the rate, the more water is displaced per unit time, and the faster the wave action.

The size of the waves is controlled by the length and speed of the piston stroke. Maximum size waves are obtained with a full fast stroke, and smaller waves by shorter slower strokes.

At the same time, inasmuch as the water is displaced only from adjacent compartments in sequence, and, is simultaneously absorbed in the next-adjacent compartments, waves are created not over the entire width of the pool but only over those portions of the width opposite the chambers in which the pistons are on their power stroke. The piston pairs because of the manner in which they are linked create waves with a 180° phase displacement, which achieves the same effect described in Belgian Pat. No. 716,775. There is however an even number of pistons along the end of the pool, when each piston is a part of an interacting piston pair, instead of an odd number, as in the Belgian patent, unless the end pistons in each array are not paired.

Any conventional means can be employed for operation of the pressure cylinders, as desired, such as an electric motor, a gasoline engine, a diesel engine, a windmill, or other conventional means.

By way of illustration, the following Example indicates the design parameters for the pistons and pressure cylinders for wavemaking apparatus of the invention.

EXAMPLE

It is possible to produce a wave of any desired proportions by designing the pistons 20 and 21 or 60 and 61 of a certain diameter and move them through a certain stroke in unit time, merely utilizing conventional engineering principles and mathematical calculations. The apparatus of FIGS. 1 to 3B is used as illustrative in the following, but since the piston 60, 61 of FIGS. 4 to 6B are of the same dimensions, the same approach applies to these as well.

FIG. 1 shows two main pistons 20 and 21, air chamber 14, pressure cylinders 34 and 35. Inside the pressure cylinders 34 and 35 are pistons 36 and 37 connected to pistons 20 and 21 by piston rods 28 and 29.

To move pistons 20 and 21, pressure can be supplied to pistons 36 and 37 from a continuous running centrifugal pump of the nonoverloading type, or from a hydropneumatic tank with gas cushion.

Assume for this illustration that it is desired to produce a wave approximately 8 feet long×3 feet wide×3 feet high. This would have a volume of 72 cubic feet of water. Sufficient water then must be displaced by pistons 20 and 21 to produce this volume.

A piston 6 feet in diameter has an area of 28.26 square feet. If this piston is moved through 2.6 feet, a volume of 73 cubic feet of water will be moved. To maintain a conventional wave shape, it is better if the distance moved (or stroke) is 3 feet.

If at the start of operation, piston 20 is at the top of the stroke and piston 21 at the bottom, the cushion of air inside both pistons will be at atmospheric (14.5 absolute) pressure. The air pressure in chamber 14 will be also at atmospheric.

Pressure is applied to the top of piston 36, and the piston moves downwards. If the pressure of the gas cushion was applied to an immovable bottom face, the pressure of the gas cushion would increase according to Boyle's Law, and a pressure of 543 psi would develop. However, the bottom side of the gas cushion is the top surface of the pool water, and as the pressure builds up, this gives way, and the gas cushion forces the water downwards into the pool.

The total load against which the piston must work is that due to the increase in height of the water at the position of the wave, as compared to the pool water surface, thus:

Height of wave=3 ft.=1.3 psi.

Diameter of piston=28.26×144=4069 $in^2$.

Load against piston=4069×1.3=5290 lbs.

Volume of water to be moved=85 cubic ft.

The piston 36 in pressure cylinder 34 must apply sufficient force to move this water. A typical pressure cylinder would have a diameter of 6 inches=28.26 square inches. The pressure applied to piston 36 must be 5290÷28.26=187 psi.

In addition to being at the right pressure, the pressure fluid must be supplied in the right quantity over the unit time. Since in the foregoing example the piston 36 is 6 inches in diameter and must move through 3 feet per stroke, 28.26×36÷=0.588 cubic feet=4.41 gallons each stroke.

The volume of water (85 cubic feet) displaced by the downward movement of piston 20 causes a similar volume of water to move out through aperture 10. The horizontal movement of this water is opposed by the inertia in the water in the length of the pool. If the movement of the water through aperture 10 is of sufficient velocity, it will rise vertically adjacent to aperture 10, and form a raised body of water, or wave, above the normal height of the pool water level.

The shape of the wave can be determined by the speed of downward movement of the piston 20. If the movement is fast, a wave with a sharp peak will be formed, while slower movement of the piston will produce shallower wave forms. A typical time for the piston 20 to move downwards for its full stroke is one second, and pressure fluid must be supplied to cylinder 34 at a sufficient rate to cause movement at this speed:

| | |
|---|---|
| Diameter of cylinder 34 | = 6 inches, stroke is 3 feet<br>= 4.41 gallons each stroke |

This must be supplied (in this Example) in one second=4.41×60=265 gpm.

Therefore, hydraulic fluid at a flow rate of 265 gpm with capabilities of applying a pressure of 187 psi should be provided.

It should be noted that his full pressure (187 psi) is not exerted over the full length of the stroke. This is best illustrated by describing the continuous movements of pistons 20 and 21.

As piston 20 moves downwards in the first stroke starting the equipment, full, or nearly full, pressure is applied on piston 36. However, as piston 20 descends, it lowers the pressure in air chamber 14 below atmospheric, thus:

Volume of air chamber (typical) 13 feet−6 inches×7 3 feet−6 inches=331 cubic feet When piston 20 moves down, the volume in the air chamber increases by 84.78 cubic feet. The pressure in air chamber 14 would be reduced to 11.5 psi absolute if piston 21 remained stationary. However, piston 21 rises, due to atmospheric pressure on the pool water surface, forcing water to the underside of the piston 21 against the air cushion in the piston, causing the piston 21 to rise.

With piston 20 at the bottom of the stroke, and piston 21 at the top of the stroke, pressure fluid is admitted into cylinder 35 on top of piston 37. Since the wave, formed by piston 20 is now descending, water will rush back through aperture 17 under piston 20, causing it to rise. As piston 21 descends, the air pressure in chamber 14 decreases, which assists in moving piston 20 upwards, in addition to the force being applied by the descending wave.

Once the pistons are in oscillating motion, full advantage is obtained from the force of the descending waves. This force in addition to the forces previously described acting in chamber 14 provide the main forces moving pistons 20 and 21.

The full pressure of the pressure fluid is only applied during the final descending movement of pistons 36 and 37.

Such a system, providing only sufficient power to keep the pistons oscillating (virtually only to overcome friction), satisfies the timely need for an energy-efficient device.

The wave-making device of the invention is applicable to any kind of swimming pool, in any desired shape. The normal wave pool, i.e. a pool in which artificial waves are created, has a fan shape, with a convex end wall opposite the wave-making device, in order to accommodate the wave action without undue wear and attrition on the peripheral walls of the pool. The tendency of waves, even artifically-created waves, is to fan outwardly from the source, and consequently a fan-shaped pool accommodates this inclination. It is however possible, of course, to apply the wave-making device in a rectangular pool, or a square pool, or a curved-wall pool of regular such as circular or elliptical or irregular configuration, as desired.

Moreover, although the drawings show the wave-making devices extending along one entire end of the pool, it is not necessary that they do so. They can extend over only a part of one end of the pool, so that the wave-making is confined to that portion of the pool. In fact, the pool itself can be divided into wave areas and quiescent areas by compartmenting the pool, with the wave-making area in one compartment. Compartmenting walls need not extend all the way across the pool, but only in the immediate vicinity of the wave-making equipment.

While the drawings show systems in which the cooperating pistons are adjacent, they can of course be spaced apart by a greater distance, although with some inefficiency in the response of the linked piston, due to the greater air volume common to the two pistons. Thus, the linked pistons can be every other piston in the array, instead of adjacent pistons. However, it is not normally effective if the pistons are spaced further apart than this.

The pistons themselves can be made of any suitable material. Because of the highly corrosive nature of swimming pool water, due to addition of pH-and halogen-controlling chemicals, it is desirable to form the pistons of noncorrosive material, such as plastic or stainless steel. Corrodible metal parts such as steel covered with a protective plastic layer can also be used. Suitable plastics include polyethylene, polypropylene, polyamide, polycarbonate, Delrin (polyoxymethylene), polyester, polytetrafluoroethylene and polytrifluorochloroethylene.

To aid in maintaining wave height all the way across the pool, it is frequently appropriate to have the deepest part of the pool at the wave-making end, and gradually decrease the pool depth towards the opposite end. The decreasing depth of the bottom aids in maintaining the height of the waves towards the opposite end, and with appropriate bottom and side wall dimensions, waves can even be made to break at the opposite end, if desired.

The groups of paired pistons can be operatively linked in any way desired. Thus, adjacent pistons of adjacent pairs can be made to move together so as to increase the wave-making volume of water discharged into the pool in each cycle by paired pistons. In effect, if the pistons are of equal size, such adjacent pairs double the volume of water affected. Such an approach is shown in the system of FIGS. 1 to 6B. On the other hand, the pistons can also be arranged so as to move exactly alternately, from pair to pair.

Inasmuch as each piston chamber is sealed off by the water below, it is unnecessary to arrange the pistons in the chambers in a fluid-tight seal. However, if desired, in order to assist in retaining the volume of air above the pistons, and prevent its gradual escape by dissolution in the water below, fluid seals can be introduced. Normally, however, it is less expensive simply to replace the air that may be lost in this way, from time to time, by application of air to the space from a compressor.

If desired, the pressure in the fluid volume above the piston pairs can also be considerably above or below atmospheric. This will materially enhance the response of the piston on the suction stroke, while not interfering with the movement of the piston on its power stroke.

Inasmuch as the volume of gas in the piston chambers is trapped, it is possible to use inert gases other than air, to reduce corrosion of the moving parts. Thus, for example, nitrogen can be used, as well as other inert gases such as methane. The rare inert gases such as helium and argon can also be used, but they are more expensive, and afford no compensating advantage.

Having regard to the foregoing disclosure, the following is claimed as inventive and patentable embodiments thereof:

1. An apparatus for making waves in bodies of water used for swimming, comprising, in combination:

(1) a housing;

(2) a multi-compartmented chamber in the housing having at least one set of separate paired compartments open in a nonintercommunicating lower portion for separate reception of water therewithin from a body of water, and closed in an intercommunicating upper portion in a manner to provide a fluid-tight upper portion confining therewithin a volume of fluid that is common to each pair of compartments;

(3) at least one pair of pistons each disposed in separate paired compartments in the chamber, each piston being mounted across its compartment for reciprocation in alternating power and suction strokes and arranged for fluid-pressure-induced interreaction with each other in balanced strokes, with the movement of each piston engaged in a power stroke interreacting with and inducing opposed movement of an interreacting piston in a suction stroke according to pressure changes in the fluid volume common thereto;

(4) each piston having an upper face with a pressure-receiving surface responding to fluid pressure in the upper portion of its compartment, and a lower face with a pressure-receiving surface responding to water pressure in the lower portion of its compartment;

(5) a plurality of separate passages and ports in the housing, each piston-containing compartment being in flow communication with its own passage and port, each passage admitting water into the housing from the body of water, the passages and ports being isolated from each other within the housing;

whereby on the power stroke each piston pushes water below it in the lower portion of its compartment into its passage and via its port into the body of water, and on the suction stroke each piston draws water from its passage via its port into the lower portion of its compartment, the resulting alternating pulses of water flow generating waves in the body of water beyond the housing moving in an outward direction from the housing, and on the power stroke the fluid pressure reduction in the volume of fluid confined in the intercommunicating upper portions of the separate paired compartments of the interreacting piston pair combined with the water pressure below the interreacting piston of the pair results in actuating that piston on its suction stroke and puts it in position for its next power stroke after the first piston has ended its power stroke.

2. An apparatus in accordance with claim 1 in which the pistons are each open at the bottom, with a gas cushion confined therewithin.

3. A swimming pool comprising side walls and a bottom adapted to retain water therewithin, and, installed at one end of the swimming pool, an apparatus in accordance with claim 2.

4. An apparatus in accordance with claim 1 in which the pistons are each closed at the bottom.

5. A swimming pool comprising side walls and a bottom adapted to retain water therewithin, and, installed at one end of the swimming pool, an apparatus in accordance with claim 4.

6. An apparatus in accordance with claim 1 in which the pistons are made of stainless steel.

7. A swimming pool comprising side walls and a bottom adapted to retain water therewithin, and, installed at one end of the swimming pool, an apparatus in accordance with claim 6.

8. An apparatus in accordance with claim 1 in which the pistons are made of plastic.

9. A swimming pool comprising side walls and a bottom adapted to retain water therewithin, and, installed at one end of the swimming pool, an apparatus in accordance with claim 8.

10. An apparatus in accordance with claim 1 in which a gas is confined within the intercommunicating upper portion of the multicompartmented chamber.

11. An apparatus in accordance with claim 10 in which the gas is air.

12. A swimming pool comprising side walls and a bottom adapted to retain water therewithin, and, installed at one end of the swimming pool, an apparatus in accordance with claim 11.

13. An apparatus in accordance with claim 10 in which the gas is nitrogen.

14. A swimming pool comprising side walls and a bottom adapted to retain water therewithin, and, installed at one end of the swimming pool, an apparatus in accordance with claim 13.

15. A swimming pool comprising side walls and a bottom adapted to retain water therewithin, and, installed at one end of the swimming pool, an apparatus in accordance with claim 10.

16. An apparatus in accordance with claim 1 in which the pistons are operated by fluid pressure.

17. A swimming pool comprising side walls and a bottom adapted to retain water therewithin, and, installed at one end of the swimming pool, an apparatus in accordance with claim 10.

18. A swimming pool comprising side walls and a bottom adapted to retain water therewithin, and, installed at one end of the swimming pool, an apparatus in accordance with claim 1.

* * * * *

UNITED STATES PATENT AND TRADEMARK OFFICE

CERTIFICATE OF CORRECTION

PATENT NO. : 4,276,661

DATED : July 7, 1981

INVENTOR(S) : William H. Baker

It is certified that error appears in the above-identified patent and that said Letters Patent are hereby corrected as shown below:

Column 11, lines 10 and 11 : "6 inches x 7 3 feet" should be --6 inches x 73 feet--

Column 14, line 45 : "10" should be --16--

Signed and Sealed this

*Eighth* Day of *July 1986*

[SEAL]

*Attest:*

DONALD J. QUIGG

*Attesting Officer*

*Commissioner of Patents and Trademarks*